US009108810B2

(12) United States Patent
Satomi

(10) Patent No.: US 9,108,810 B2
(45) Date of Patent: Aug. 18, 2015

(54) SHEET CONVEYING APPARATUS AND IMAGE FORMING APPARATUS

(71) Applicant: CANON KABUSHIKI KAISHA, Tokyo (JP)

(72) Inventor: Yoshiyasu Satomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/972,114

(22) Filed: Aug. 21, 2013

(65) Prior Publication Data

US 2014/0062011 A1 Mar. 6, 2014

(30) Foreign Application Priority Data

Sep. 4, 2012 (JP) ..... 2012-193667

(51) Int. Cl.

| | |
|---|---|
| ***B65H 5/00*** | (2006.01) |
| ***B65H 5/38*** | (2006.01) |
| ***B65H 29/12*** | (2006.01) |
| ***B65H 5/06*** | (2006.01) |
| ***G03G 15/00*** | (2006.01) |

(52) U.S. Cl.

CPC ..... *B65H 5/00* (2013.01); *B65H 5/062* (2013.01); *B65H 5/38* (2013.01); *B65H 29/125* (2013.01); *G03G 15/6529* (2013.01); *B65H 2301/51256* (2013.01); *B65H 2402/545* (2013.01); *B65H 2404/1521* (2013.01); *B65H 2404/611* (2013.01); *B65H 2407/31* (2013.01); *B65H 2601/11* (2013.01); *B65H 2801/06* (2013.01); *G03G 15/6552* (2013.01); *G03G 15/6573* (2013.01); *G03G 15/6576* (2013.01); *G03G 2215/00675* (2013.01)

(58) Field of Classification Search

CPC ..... B65H 2601/11; B65H 2301/51256; B65H 2407/31; B65H 29/125; B65H 5/062; B65H 5/38; G03G 15/6529

USPC ..... 271/264, 83, 273; 399/124, 21

See application file for complete search history.

(56) References Cited

U.S. PATENT DOCUMENTS

| | | | | |
|---|---|---|---|---|
| 6,283,655 | B1 * | 9/2001 | Thomas et al. | 400/634 |
| 6,993,268 | B2 * | 1/2006 | Otaka | 399/124 |
| 8,005,393 | B2 | 8/2011 | Satomi | |
| 2002/0008352 | A1 * | 1/2002 | Hanano | 271/273 |
| 2002/0145250 | A1 * | 10/2002 | Chen | 271/273 |
| 2004/0042819 | A1 * | 3/2004 | Kobayashi | 399/124 |
| 2009/0295081 | A1 * | 12/2009 | Hirata et al. | 271/264 |

FOREIGN PATENT DOCUMENTS

| | | | |
|---|---|---|---|
| JP | 2005-31216 | A | 2/2005 |
| JP | 2007-240843 | A | 9/2007 |
| JP | 2007240843 | A * | 9/2007 |
| JP | 4405192 | B2 | 1/2010 |
| JP | 4891634 | B2 | 3/2012 |

* cited by examiner

*Primary Examiner* — Patrick Cicchino

(74) *Attorney, Agent, or Firm* — Fitzpatrick, Cella, Harper & Scinto

(57) ABSTRACT

A sheet conveying apparatus comprising: a guide portion which guides a sheet; a support portion which rotatably supports the guide portion; a biasing portion which applies a force to the guide portion to be at a closed position with respect to the support portion and is provided to be detachably attachable; and a stopper portion which contacts with the biasing portion to regulate a rotation of the guide portion in a direction that the guide portion opens.

9 Claims, 14 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus having the same.

2. Description of the Related Art

In an image forming apparatus represented by a copying machine or a printer, when sheet clogging (jam) occurs, a guide member rotates about a pivot to easily take out a jammed sheet and thus the jammed sheet is easily taken out (see Japanese Patent Laid-Open No. 2005-031216). A force is constantly applied to the guide member to be positioned at a closed position for guiding a sheet by a spring. Here, when the guide member is largely opened at the time of the jam recovery of the sheet, the spring which applies a force to the guide member at the closed position becomes weak by metal fatigue. Therefore, it is difficult to keep the guide member at a position of guiding the sheet, and thus a defect of conveyance of the sheet may occur.

In addition, when a service representative maintains the image forming apparatus, it is necessary to clean toner, paper dust, and wax attached to the guide member, a conveying roller, and a sheet detecting sensor. For this reason, it is desirable that the guide member can be largely opened or can be simply detached.

Accordingly, it is desirable that the amount of rotation of the guide member which conveys a sheet is restricted at the time of jam recovery, and the guide member can rotate by an amount of rotation possible in maintenance or the guide member can be detachable at the time of maintenance.

It is desirable to provide a sheet conveying apparatus in which an amount of rotation of a guide member that conveys a sheet is variable, and it is possible to perform maintenance such as jam recovery of the sheet and cleaning of the guide member without decreasing performance of conveying the sheet.

SUMMARY OF THE INVENTION

According to an aspect of the invention, there is provided a sheet conveying apparatus comprising: a guide portion which guides a sheet; a support portion which rotatably supports the guide portion; a biasing portion which applies a force to the guide portion to be at a closed position with respect to the support portion and is provided to be detachably attachable; and a stopper portion which contacts with the biasing portion to regulate a rotation of the guide portion in a direction that the guide portion opens.

Further features of the present invention will become apparent from the following description of exemplary embodiments with reference to the attached drawings.

DESCRIPTION OF THE EMBODIMENTS

An image forming apparatus according to an embodiment of the invention will be described in detail with reference to the drawings.

Embodiment 1

First, a configuration of an image forming apparatus according to a first embodiment of the invention will be described with reference to FIG. 1 to FIG. 7. In addition, the embodiment is an exemplary embodiment of the invention, and the invention is not limited to such an embodiment.

Figure 1:
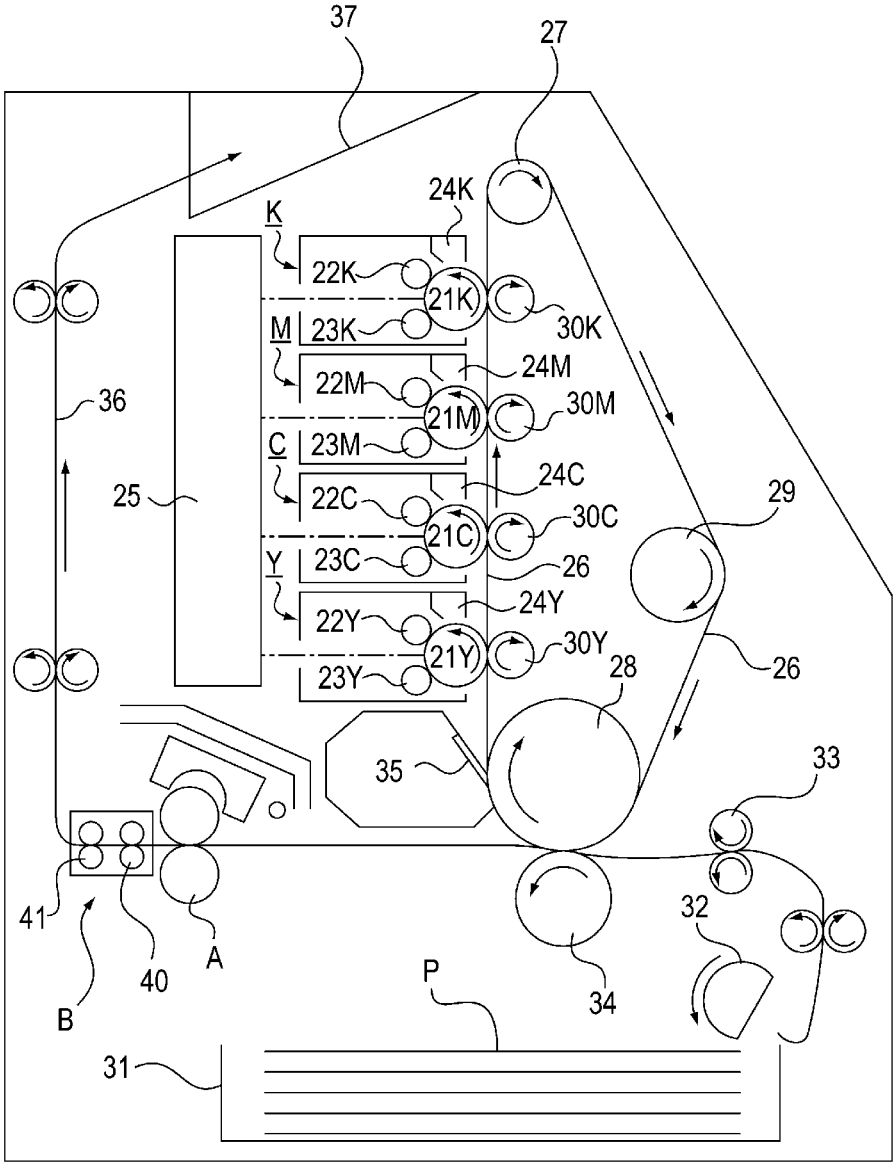
FIG. 1 is a cross-sectional view illustrating an image forming apparatus according to the invention.

<Image Forming Apparatus> An image forming apparatus according to an embodiment illustrated in FIG. 1 is an example of a color image forming apparatus using an electrophotographic system.

In FIG. 1, four image forming portions Y, C, M, and K form toner images of colors of yellow, cyan, magenta and black, and are sequentially arranged upward from a lower portion of FIG. 1.

The image forming portions Y, C, M, and K include photoreceptor drums 21Y, 21C, 21M, and 21K that are image bearing members, and charging devices 22Y, 22C, 22M, and 22K that are charging portions, respectively. In addition, they include development devices 23Y, 23C, 23M, and 23K that are development portions, and cleaning devices 24Y, 24C, 24M, and 24K that are cleaning portions, respectively.

In addition, for convenience of description, a photoreceptor drum 21 may be representatively described as the photoreceptor drums 21Y, 21C, 21M, and 21K. Components constituting the other image forming unit are also described in such a manner.

A yellow toner is accommodated in the development device 23Y of the yellow image forming portion Y. A cyan toner is accommodated in the development device 23C of the cyan image forming portion C. A magenta toner is accommodated in the development device 23M of the magenta image forming portion M. A black toner is accommodated in the development device 23K of the black image forming portion K.

A laser exposure device 25 is provided corresponding to four image forming portions Y, C, M, and K. Scanning exposure is performed by laser light corresponding to image information emitted from the laser exposure device 25 to each photoreceptor drum 21, the surface of which is uniformly charged by the charging device 22, to form an electrostatic latent image corresponding to a scanning exposure image pattern of each color on the surface of each photoreceptor drum 21.

The toner of each color is supplied, and the electrostatic latent image formed on the surface of each photoreceptor drum 21 is developed as a toner image by the development device 23 of each color. That is, a yellow toner image is formed on the photoreceptor drum 21Y of the yellow image forming portion Y. A cyan toner image is formed on the photoreceptor drum 21C of the cyan image forming portion C. A magenta toner image is formed on the photoreceptor drum 21M of the magenta image forming portion M. A black toner image is formed on the photoreceptor drum 21K of the black image forming portion K.

The toner images of each color formed on the photoreceptor drums 21 of the image forming portions Y, C, M, and K are sequentially superimposed and primarily transferred in a predetermined positioning state on an outer peripheral face of an intermediate transfer belt 26 rotating substantially at a uniform velocity, synchronizing the rotation of the photoreceptor drums 21. Accordingly, a non-fixed full-color toner image is synthesized and formed on the intermediate transfer belt 26.

The intermediate transfer belt 26 is tensioned by three rollers of a driving roller 27, a secondary transfer roller counter roller 28, and a tension roller 29, and is driven to rotate by the rotation driving of the driving roller 27.

As a primary transfer portion of the toner image on the intermediate transfer belt 26 from the photoreceptor drums 21 of the image forming portions Y, C, M, and K, a primary transfer roller 30 provided to be opposed to the photoreceptor drums 21 on the inner peripheral face side of the intermediate transfer belt 26 is used. A primary transfer bias voltage having opposite-polarity to a toner is applied to the primary transfer roller 30 by a bias power supply (not illustrated). Accordingly, the toner image is primarily transferred to the intermediate transfer belt 26 from the photoreceptor drums 21 of the image forming portions Y, C, M, and K. After the primary transferring to the intermediate transfer belt 26 from the photoreceptor drums 21 in the image forming portions Y, C, M, and K, the toner remaining on the photoreceptor drum 21 is scrapped and removed by a cleaning device 24.

The image forming process is performed on each color of yellow, magenta, cyan, and black, synchronizing with the rotation of the intermediate transfer belt 26. The primary transfer toner images of each color are formed on the intermediate transfer belt 26 in a sequentially superimposed manner. In addition, at the time of only-monochromatic image formation (monochromatic mode), the image forming process is performed only on a desired color.

Meanwhile, a sheet P accommodated in a sheet cassette 31 is continuously fed by a feeding roller 32, and is separated and fed one-by-one by a separation portion (not illustrated). Thereafter, the sheet P is conveyed to a transfer nip portion formed by the intermediate transfer belt 26 wound on the secondary transfer roller counter roller 28 and a secondary transfer roller 34 at a predetermined timing by a registration roller 33.

The toner images formed on the outer peripheral face of the intermediate transfer belt 26 are collectively transferred onto the sheet P by the toner applied to the secondary transfer roller 34 by the bias power supply (not illustrated) and a transfer bias voltage having opposite-polarity to the toner. The toner remaining on the outer peripheral face of the intermediate transfer belt 26 after the secondary transferring is scraped and removed by a cleaning device 35.

The toner image secondarily transferred onto the sheet P is heated and pressurized by a fixing device A that is a fixing portion, and is melted, mixed, and fixed on the sheet P. The toner image is discharged to a discharge tray 37 through an inner discharge conveying portion B and a discharge path 36 of the sheet conveying apparatus, as a full-color print.

Figure 2:
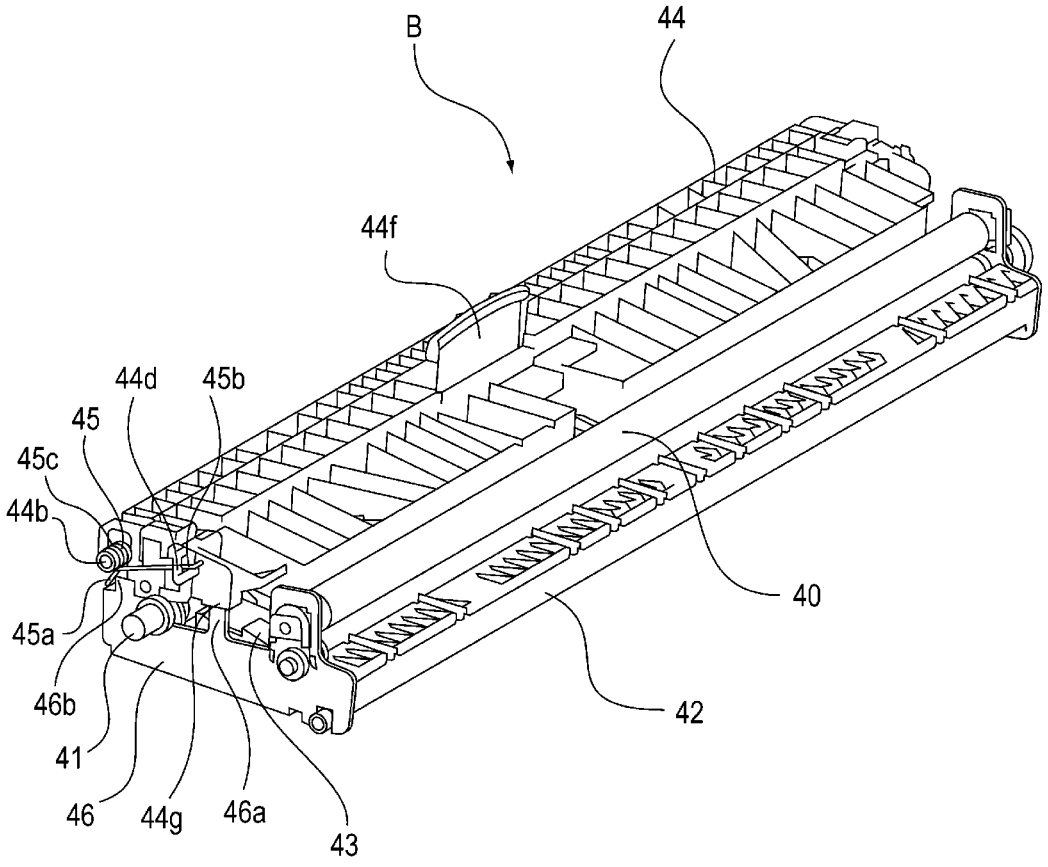
FIG. 2 is a perspective view illustrating a state where a guide member is at a closed position with respect to a support member in an image forming apparatus according to a first embodiment of the invention.
Figure 3:
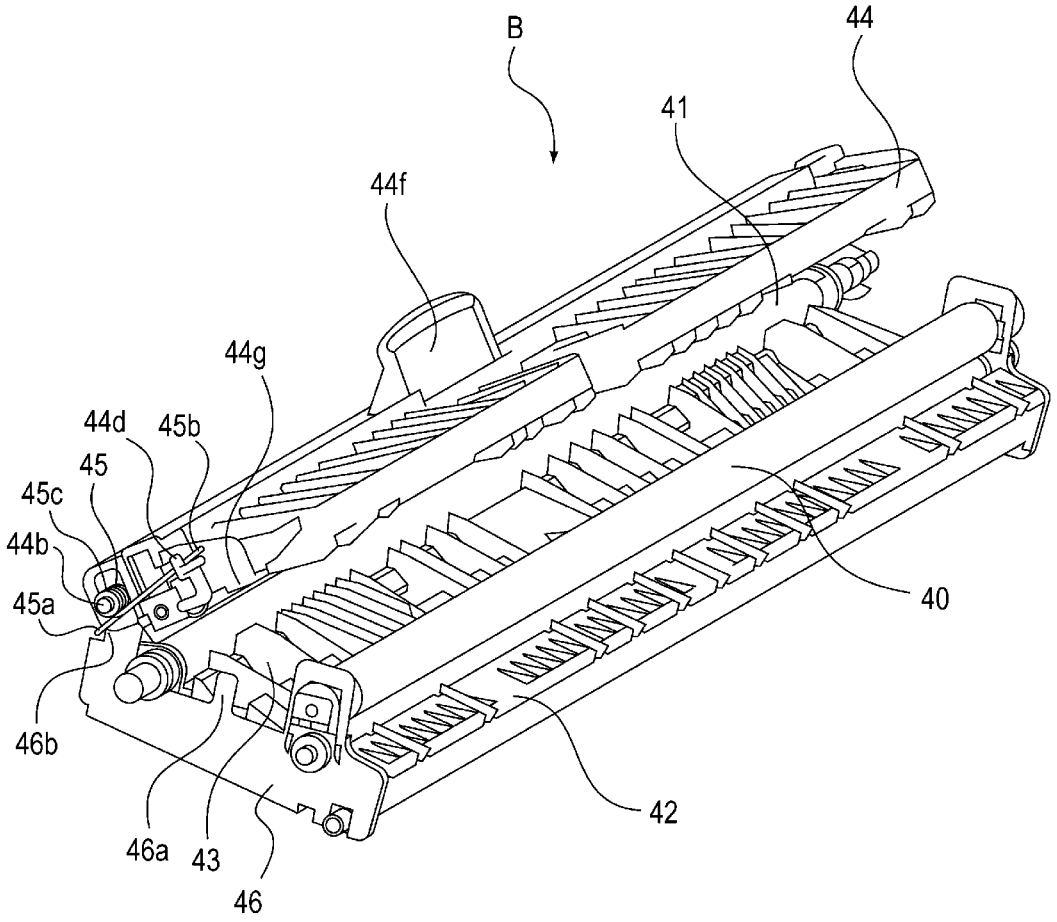
FIG. 3 is a perspective view illustrating a state where the guide member is at an open position with respect to the support member in the first embodiment.

<Inner Discharge Conveying Portion> FIG. 2 is a perspective view illustrating a state where an upper conveying guide 44, which is a guide portion conveying the sheet P, is at a closed position with respect to a support member 46 that rotatably supports the upper conveying guide 44. FIG. 3 is a perspective view illustrating a state where the upper conveying guide 44 is at an open position with respect to the support member 46.

As illustrated in FIG. 1, the inner discharge conveying portion B is disposed immediately after the downstream side in the sheet conveying direction of the fixing device A, and has inner discharge rollers 40 and 41 to suppress curl occurring immediately after the thermally fixing of the sheet P. In the inner discharge rollers 40 and 41, the face side on which the toner image of the sheet P is formed, is formed of a roller obtained by coating metal rollers with fluorine resin. The non-image face side of the sheet P is formed of a roller obtained by providing a sponge layer on a metal shaft and coating a surface layer with fluorine resin. As described above, the curl amount of the sheet P is suppressed by a difference in thermal conduction of a pair of rollers.

The inner discharge conveying portion B includes a first lower conveying guide 42, a second lower conveying guide 43, and the upper conveying guide 44 which guide the sheet P, and each guide is provided with a hole for improving ventilation characteristics to prevent dew condensation caused by moisture generated from the sheet P immediately after the fixing. In addition, each guide is formed of synthetic resin.

The upper conveying guide 44 rotates about a rotation shaft 44*b* that is a rotation center for jam recovery of the sheet P, and can open the upper conveying guide 44 with respect to the first lower conveying guide 42 and the second lower conveying guide 43.

A fitting portion 45*c* of a torsion coil spring 45 is fitted to the rotation shaft 44*b* that is a shaft portion provided on the upper conveying guide 44. The torsion coil spring 45 is configured as a biasing portion that applies a force to the upper conveying guide 44 to be at a closed position illustrated in FIG. 2 with respect to the support member 46 as the support portion.

Figure 4:
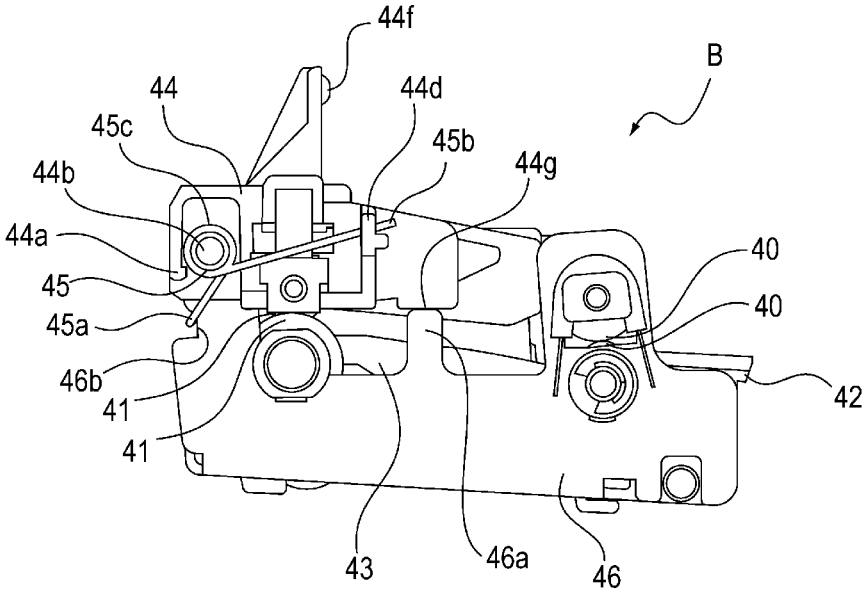
FIG. 4 is a side view illustrating a state where the guide member is at the closed position with respect to the support member in the first embodiment.
Figure 5:
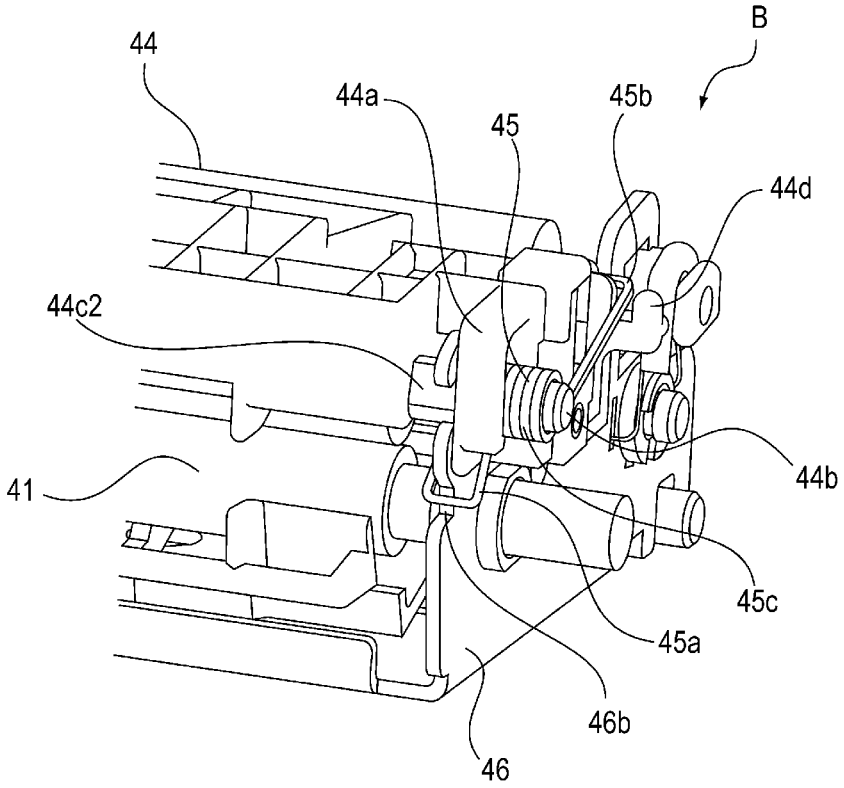
FIG. 5 is a perspective view illustrating a state where the guide member is at the closed position with respect to the support member in the first embodiment.

FIG. 4 is a side view illustrating a state where the upper conveying guide 44 is at a closed position with respect to the support member 46. FIG. 5 is a perspective view illustrating a state where the upper conveying guide 44 is at the closed position with respect to the support member 46. As illustrated in FIG. 5, the fitting portion 45*c* of the torsion coil spring 45 is fitted to be detachably attachable to the rotation shaft 44*b* that is the rotation center of the upper conveying guide 44. Accordingly, the torsion coil spring 45 is disposed on the same shaft as the rotation shaft 44*b* that is the rotation center of the upper conveying guide 44.

One end portion 45*a* of the torsion coil spring 45 is locked to be detachably attachable to a spring attaching portion 46*b* provided on the support member 46, and the other end portion 45*b* is locked to be detachably attachable to a spring attaching portion 44*d* provided on the upper conveying guide 44.

A force is constantly applied to the upper conveying guide 44 in a clockwise direction of FIG. 4 about the rotation shaft 44*b* by an elastic force of the torsion coil spring 45. An abutting portion 44*g* provided on the upper conveying guide 44 abuts a stopper portion 46*a* provided on the support member 46, and thus the upper conveying guide 44 is kept at a guide position illustrated in FIG. 4.

Figure 6:
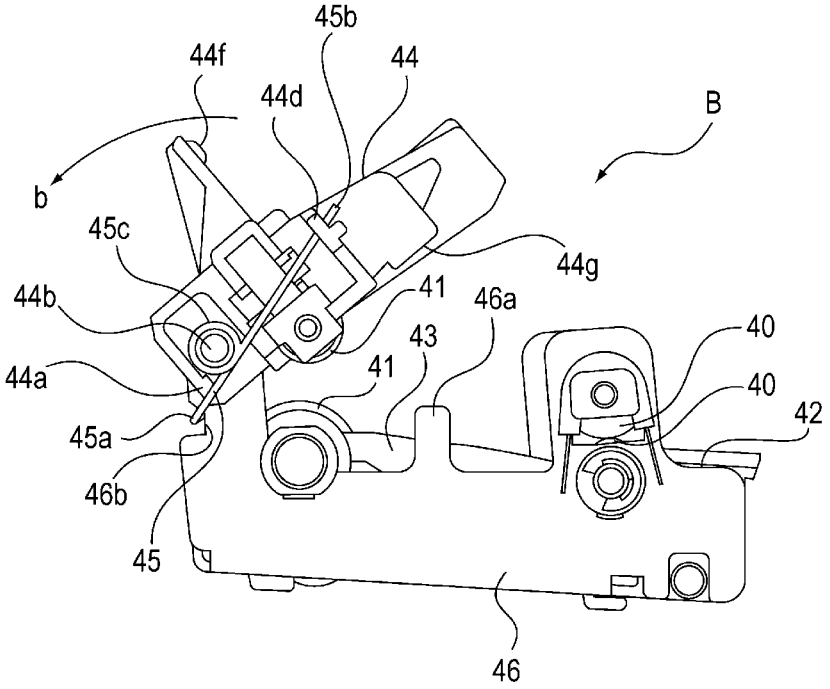
FIG. 6 is a side view illustrating a state where the guide member is at the open position with respect to the support member in the first embodiment.

FIG. 6 is a side view illustrating a state where the upper conveying guide 44 is at the open position with respect to the support member 46. When the sheet P is jammed in the inner discharge conveying portion B, a knob portion 44*f* provided on the upper conveying guide 44 is press-rotated in the direction of the arrow b of FIG. 6 in the reverse direction to the biasing direction based on the torsion coil spring 45 about the rotation shaft 44*b*, to rotate and open the upper conveying guide 44.

In the upper conveying guide 44, a stopper portion 44*a* provided on the upper conveying guide 44 abuts an arm portion between the fitting portion 45*c* of the torsion coil spring 45 and one end portion 45*a*, and thus the rotation of the upper conveying guide 44 in the direction of the arrow b of FIG. 6 is regulated as illustrated in FIG. 6. The position of the upper conveying guide 44 illustrated in FIG. 6 in which the rotation is regulated by abutting the torsion coil spring 45 to the stopper portion 44*a* is referred to as a first position. The upper conveying guide 44 is not opened in the direction of the arrow b of FIG. 6 more than that. That is, the stopper portion 44*a* provided on the upper conveying guide 44 abuts the arm portion between the fitting portion 45*c* of the torsion coil spring 45 and one end portion 45*a*, to regulate an open angle of the upper conveying guide 44.

By regulating the rotation in the open direction of the upper conveying guide 44, it is prevented that the upper conveying guide 44 is largely opened and the user carelessly comes in contact with the inner discharge roller 41. Accordingly, it is possible to prevent the inner discharge roller 41 from being damaged in advance. In addition, it is possible to prevent that the upper conveying guide 44 is largely opened so that the torsion coil spring 45 becomes weak by metal fatigue.

As illustrated in FIG. 4, the stopper portion 44*a* provided on the upper conveying guide 44 is disposed to abut a portion between the fitting portion 45*c* of the torsion coil spring 45 and one end portion 45*a* of the torsion coil spring 45. The fitting portion 45*c* of the torsion coil spring 45 is fitted to the rotation shaft 44*b* of the upper conveying guide 44. One end portion 45*a* of the torsion coil spring 45 is locked to the spring attaching portion 46*b*. Accordingly, it is possible to compactly configure the sheet conveying apparatus without needing a space only for the stopper portion 44*a*.

Figure 7:
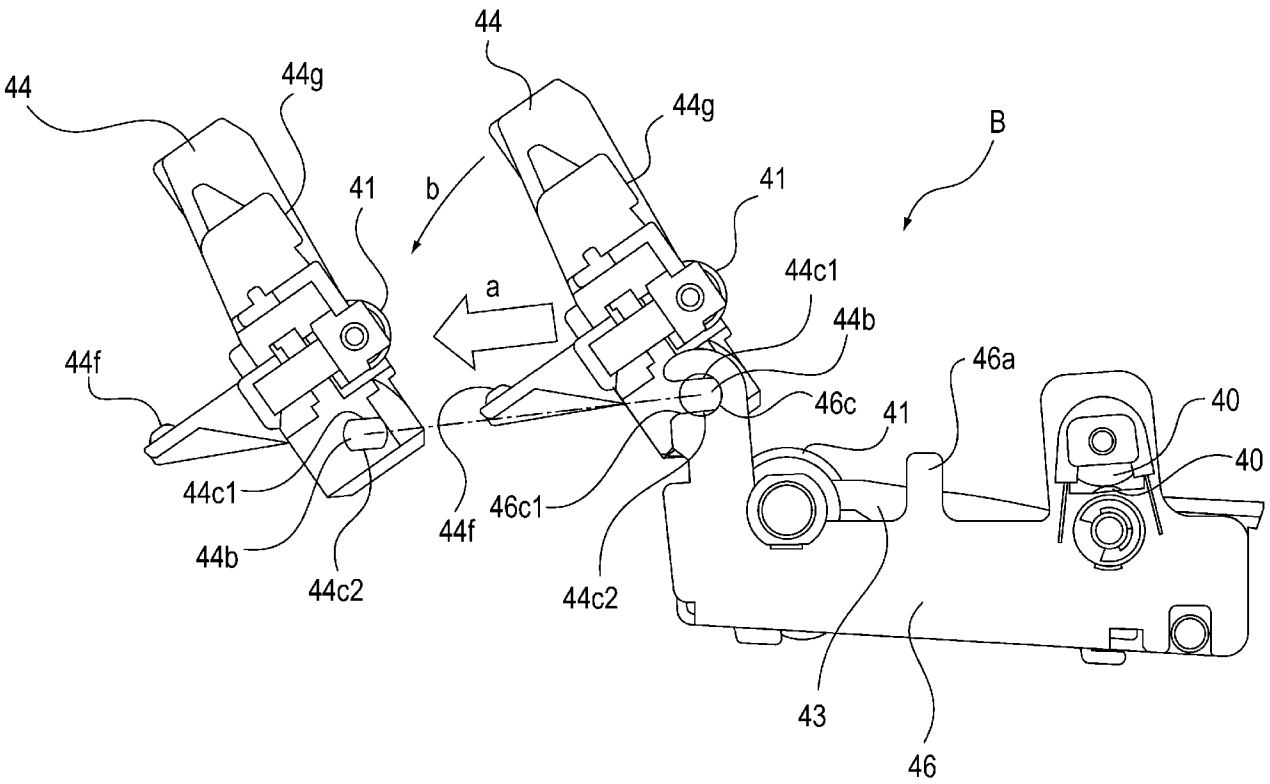
FIG. 7 is a side view illustrating that the guide member is detached from the support member in the first embodiment.

FIG. 7 is a side view illustrating that the detachably attachable torsion coil spring 45 is detached and the upper conveying guide 44 is separated from the support member 46. When cleaning or component changing in the inner discharge conveying portion B is performed, it is necessary to largely open the upper conveying guide 44.

As illustrated in FIG. 7, by separating one end portion 45*a* and the other end portion 45*b* of the torsion coil spring 45 from the spring attaching portions 44*d* and 46*b*, the torsion coil spring 45 is detached from the rotation shaft 44*b*. The torsion coil spring 45 hooks one end portion 45*a* and the other end portion 45*b* of the torsion coil spring 45 to be detachably attachable to the spring attaching portion 44*d* of the upper conveying guide 44 and the spring attaching portion 46*b* of the support member 46, and thus can be easily detached.

When the torsion coil spring 45 is detached, a component which abuts the stopper portion 44*a* provided on the upper conveying guide 44 disappears, and thus the component which regulates the rotation in the open direction of the upper conveying guide 44 disappears. Accordingly, the upper conveying guide 44 can rotate in the direction of the arrow b of FIG. 7 more than the first position illustrated in FIG. 6. The upper conveying guide 44 can rotate to a second position illustrated in FIG. 7.

At a fitting portion between the upper conveying guide 44 and the support member 46, as illustrated in FIG. 7, flat faces 44*c*1 and 44*c*2 in which two cylindrical faces are chamfered are formed at a part of the rotation shaft 44*b* provided on the upper conveying guide 44. The chamfered flat faces 44*c*1 and 44*c*2 of the rotation shaft 44*b* are inserted into a bearing portion 46*c*, which is provided in the support member 46 and provided with a notch portion 46*c*1 on one side, from the notch portion 46*c*1, and the rotation shaft 44*b* is provided to be detachably attachable in the bearing portion 46*c*.

Accordingly, the upper conveying guide 44 is rotated about the rotation shaft 44*b* to the second position illustrated in FIG. 7 in the direction of the arrow b of FIG. 7. In that state, the position of the chamfered flat faces 44*c*1 and 44*c*2 of the rotation shaft 44*b* is matched with the position of the notch portion 46*c*1, and the upper conveying guide 44 is moved in the direction of the arrow a of FIG. 7. Accordingly, it is possible to detach the upper conveying guide 44 from the support member 46 in the direction of the arrow a of FIG. 7.

The upper conveying guide 44 is rotated in the direction of the arrow b of FIG. 7 about the rotation shaft 44*b* over the first position illustrated in FIG. 6. Accordingly, the sheet guiding in the inner discharge conveying portion B, the cleaning of the inner discharge rollers 40 and 41, and the exchanging of the component can be easily performed. In addition, as illustrated in FIG. 7, by detaching the upper conveying guide 44 from the support member 46, it is possible to further simplify the sheet guiding in the inner discharge conveying portion B, the cleaning of the inner discharge rollers 40 and 41, and the exchanging of the component.

Embodiment 2

Next, a configuration of an image forming apparatus according to a second embodiment of the invention will be described with reference to FIG. 8 to FIG. 11. In addition, the same reference numerals and signs are given to the same configurations as those of the first embodiment, and the description thereof will not be repeated.

Figure 8:
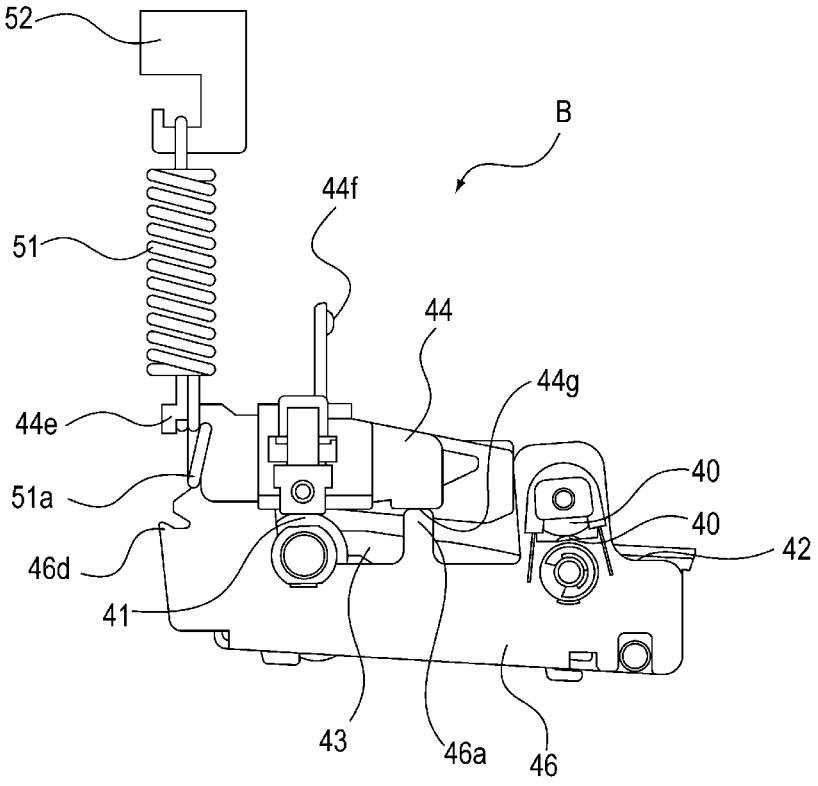
FIG. 8 is a side view illustrating a state where a guide member is at a closed position with respect to a support member in an image forming apparatus according to a second embodiment of the invention.
Figure 9:
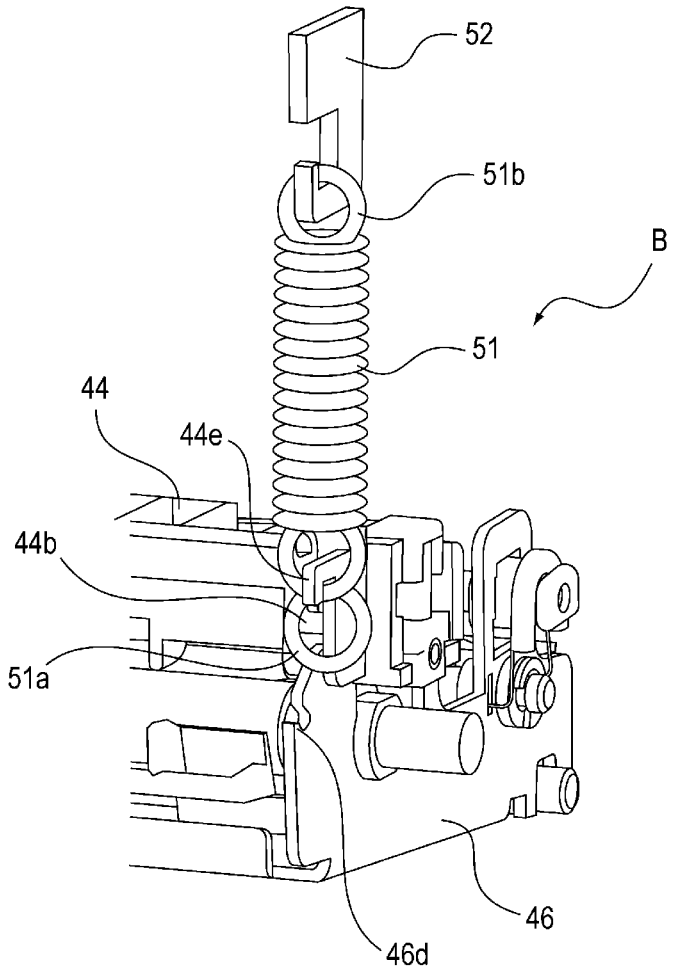
FIG. 9 is a perspective view illustrating a state where the guide member is at the closed position with respect to the support member in the second embodiment.

<Inner Discharge Conveying Portion> FIG. 8 is a side view illustrating a state where the upper conveying guide 44 is at the closed position with respect to the support member 46 in the embodiment. FIG. 9 is a perspective view illustrating a state where the upper conveying guide 44 is at the closed position with respect to the support member 46 in the embodiment. As illustrated in FIG. 1, the inner discharge conveying portion B of the sheet conveying apparatus is disposed immediately after the downstream side in the sheet conveying direction of the fixing device A. The inner discharge conveying portion B has the inner discharge rollers 40 and 41 to suppress curl of the sheet P immediately after heat-fixing.

The upper conveying guide 44 is supported by the support member 46 to be rotatable about the rotation shaft 44*b* that is the rotation center for jam recovery of the sheet P.

In the embodiment, a tension spring 51 that is detachably attachable as a biasing portion applying a force to the upper conveying guide 44 to be at a closed position with respect to the support member 46 is provided. One end portion 51*a* of the tension spring 51 is locked to be detachably attachable to a spring attaching portion 44*e* provided on the upper conveying guide 44. The other end portion 51*b* of the tension spring 51 is locked to be detachably attachable to a spring attaching portion 52 provided in a device frame (not illustrated).

A force is constantly applied to the upper conveying guide 44 in a clockwise direction of FIG. 8 about the rotation shaft 44*b* that is the rotation center by a tensile strength of the tension spring 51. The abutting portion 44*g* provided on the upper conveying guide 44 abuts the stopper portion 46*a* provided on the support member 46 to be disposed at a guide position illustrated in FIG. 8.

Figure 10:
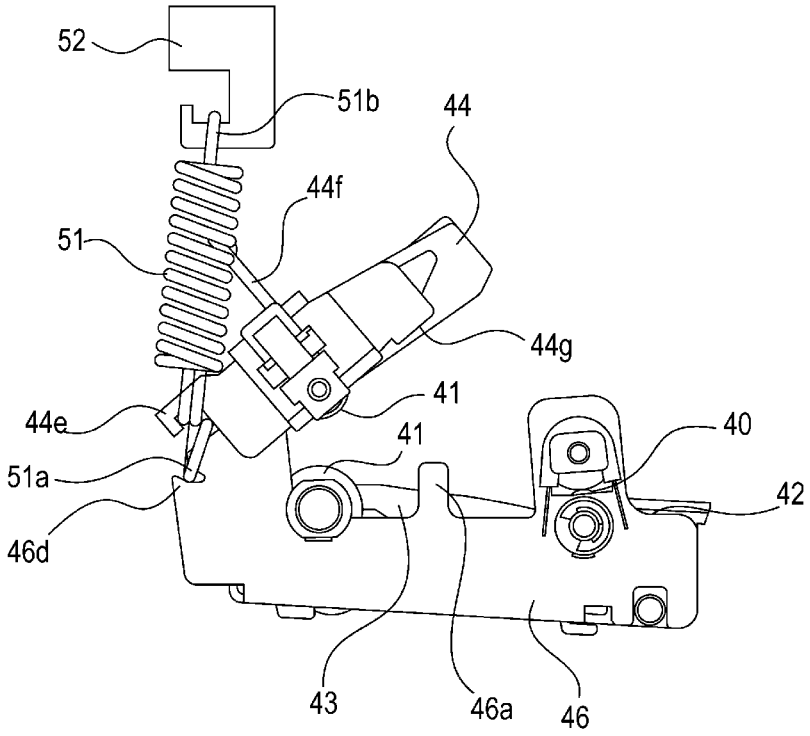
FIG. 10 is a side view illustrating a state where the guide member is at the open position with respect to the support member in the second embodiment.
Figure 11:
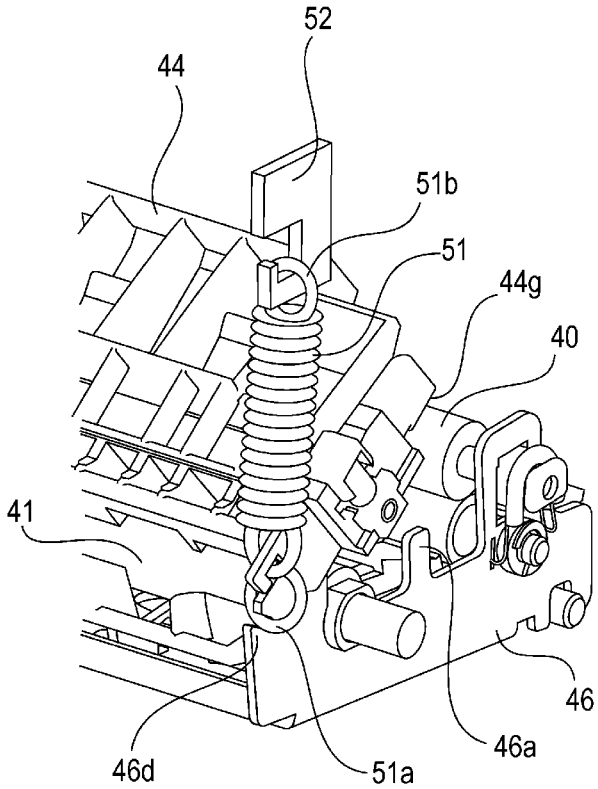
FIG. 11 is a perspective view illustrating a state where the guide member is at the open position with respect to the support member in the second embodiment.

FIG. 10 is a side view illustrating a state where the upper conveying guide 44 is at the open position with respect to the support member 46 in the embodiment. FIG. 11 is a perspective view illustrating a state where the upper conveying guide 44 is at the open position with respect to the support member 46 in the embodiment.

When the sheet P is jammed in the inner discharge conveying portion B, the knob portion 44*f* provided on the upper conveying guide 44 is press-rotated in a counterclockwise direction of FIG. 10 in the reverse direction to the biasing direction based on the tension spring 51 about the rotation shaft 44*b* that is the rotation center, to open the upper conveying guide 44.

The support member 46 is provided with a stopper portion 46*d* that contacts one end portion 51*a* of the tension spring 51 to regulate an open angle of the upper conveying guide 44.

The upper conveying guide 44 is press-rotated in the counterclockwise direction of FIG. 10 about the rotation shaft 44*b* that is the rotation center. At that time, one end portion 51*a* of the tension spring 51 locked to the spring attaching portion 44*e* of the upper conveying guide 44 abuts the stopper portion 46*d* provided on the support member 46 to regulate the open angle of the upper conveying guide 44.

Accordingly, the rotation of the upper conveying guide 44 is regulated at the position illustrated in FIG. 10, and is not opened more than that. Hereinafter, the position of the upper conveying guide 44 illustrated in FIG. 10 in which the rotation is regulated by abutting one end portion 51*a* of the tension spring 51 to the stopper portion 46*d* is referred to as the first position. In addition, one end portion 51*a* of the tension spring 51 is detached from the spring attaching portion 44*e* of the upper conveying guide 44. In addition, the other end portion 51*b* of the tension spring 51 is detached from the spring attaching portion 52 provided in a device frame (not illustrated). The tension spring 51 is detached.

In that state, the component on the upper conveying guide 44 side abutting the stopper portion 46*d* provided on the support member 46 disappears. Accordingly, the regulating of the rotation in the open direction of the upper conveying guide 44 disappears. Accordingly, the upper conveying guide 44 can be rotated in the counterclockwise direction of FIG. 10 over the first position illustrated in FIG. 10. The other configuration is the same as that of the first embodiment, and it is possible to obtain the same effect.

Embodiment 3

Figure 13:
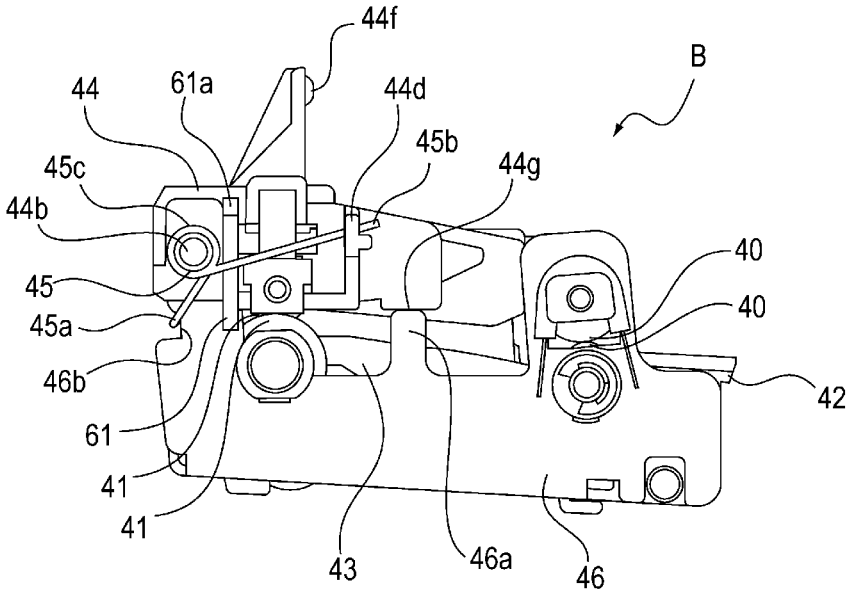
FIG. 13 is a side view illustrating a state where the guide member is at the closed position with respect to the support member in the third embodiment.
Figure 14:
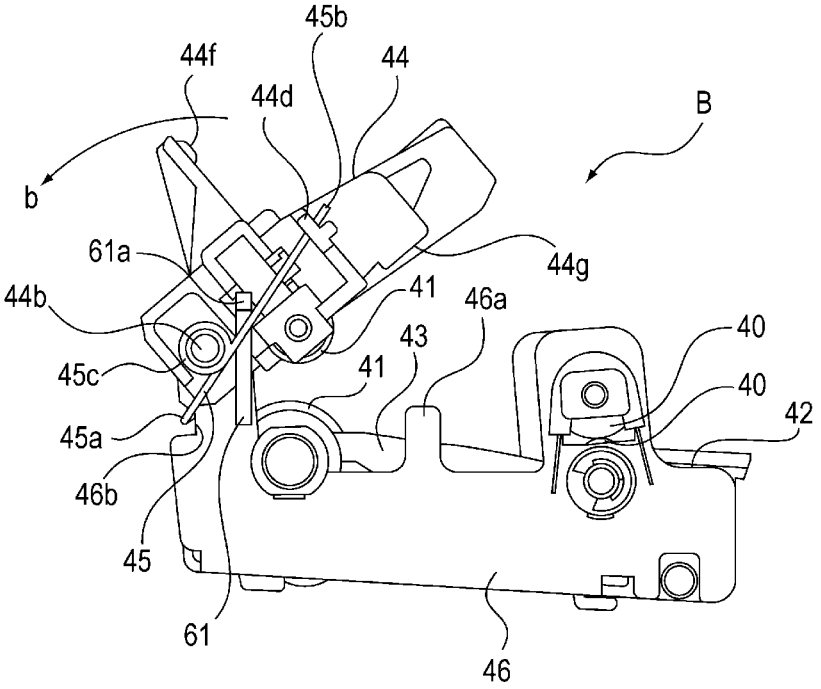
FIG. 14 is a side view illustrating a state where the guide member is at an open position with respect to the support member in the third embodiment.

Next, an image forming apparatus according to a third embodiment of the invention will be described with reference to FIG. 12 to FIG. 14. In addition, the same reference numerals and signs are given to the same configurations as those of the embodiments, and the description thereof will not be repeated.

In the first embodiment, the stopper portion 44*a* to which the torsion coil spring 45 abuts is provided on the upper conveying guide 44. In this embodiment, a stopper portion 61*a* to which the torsion coil spring 45 abuts is provided on the support member 46.

Figure 12:
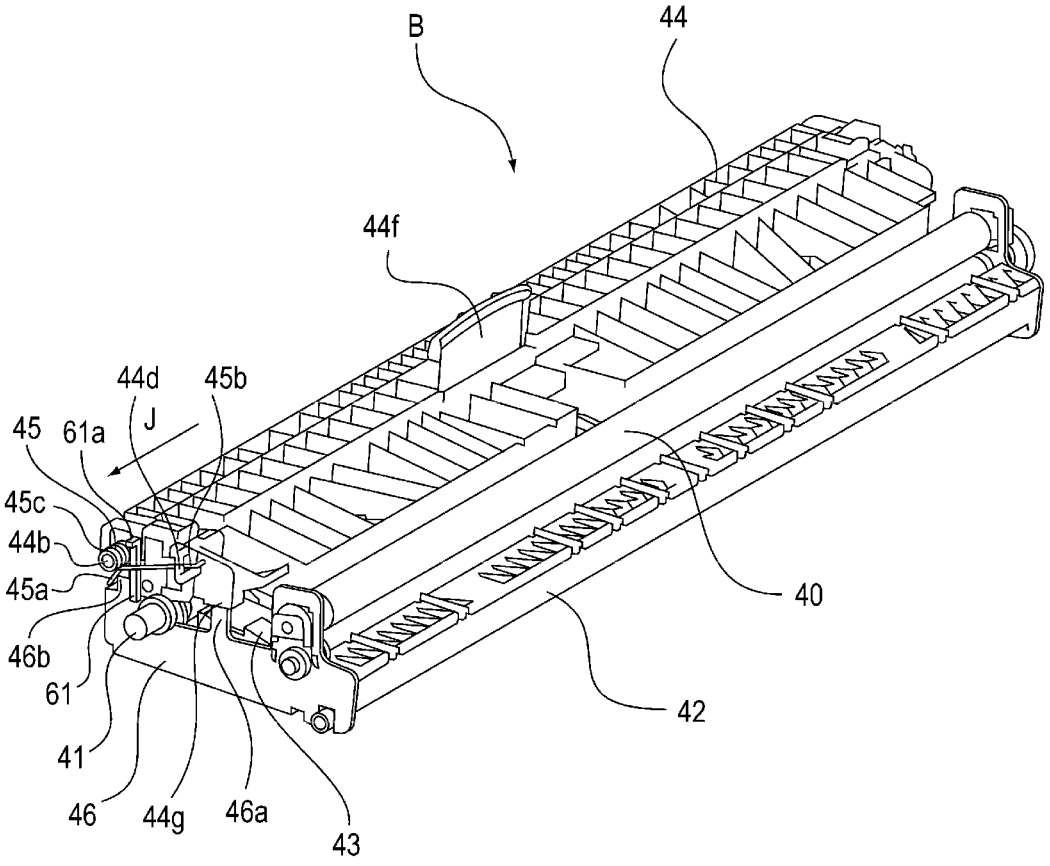
FIG. 12 is a perspective view illustrating a state where a guide member is at a closed position with respect to a support member in an image forming apparatus according to a third embodiment of the invention.

FIG. 12 is a perspective view illustrating a state where the upper conveying guide 44 is at the closed position with respect to the support member 46 in the embodiment. FIG. 13 is a side view illustrating a state where the upper conveying guide 44 is at the closed position with respect to the support member 46. FIG. 14 is a side view illustrating a state where the upper conveying guide 44 is at the open position with respect to the support member 46.

In the embodiment, an arm portion 61 having the stopper portion 61*a* formed of a protrusion contacting with the torsion coil spring 45 is provided to extend upward to regulate the open angle of the upper conveying guide 44 from the support member 46 on the second lower conveying guide 43 side.

At the upper end portion of the arm portion 61 extending upward from the support member 46, the stopper portion 61*a* formed of a protrusion protruding in the direction of the arrow J of FIG. 12 is provided. As illustrated in FIG. 14, when the upper conveying guide 44 is opened, the stopper portion 61*a* abuts a portion between the fitting portion 45*c* and the other end portion 45*b* of the torsion coil spring 45, to regulate the open angle of the upper conveying guide 44. The other configuration is the same as that of the first embodiment, and it is possible to obtain the same effect.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-193667, filed Sep. 4, 2012, which is hereby incorporated by reference herein in its entirety.

What is claimed is:

1. A sheet conveying apparatus comprising:

a guide portion which guides a sheet;

a support portion which rotatably supports the guide portion;

a biasing member which applies a force to the guide portion urging the guide portion to rotate towards a closed position with respect to the support portion, the biasing member provided to be detachably attached to the sheet conveying apparatus; and a stopper portion which comes into contact with the biasing member for stopping a rotation of the guide portion in a direction that the guide portion opens against the force of the biasing member.

2. The sheet conveying apparatus according to claim 1, wherein the biasing member is formed of a torsion coil spring which is disposed on a shaft as a rotation center of the guide portion, and wherein when the guide portion is rotated in the direction that the guide portion opens against a force of the torsion coil spring, the torsion coil spring abuts the stopper portion to stop the rotation of the guide portion.

3. The sheet conveying apparatus according to claim 1, further comprising:

a shaft portion which is provided on the guide portion and to which a fitting portion of a torsion coil spring is fitted; and a spring attaching portion which is provided on the support portion and to which an end portion of the torsion coil spring is attached, wherein the stopper portion is provided on the guide portion, and the stopper portion abuts a portion between the fitting portion fitted to the shaft portion of the torsion coil spring and the end portion of the torsion coil spring attached to the spring attaching portion.

4. The sheet conveying apparatus according to claim 1, further comprising:

a shaft portion which is provided on the guide portion and to which a fitting portion of a torsion coil spring is fitted; and a spring attaching portion which is provided on the guide portion and to which an end portion of the torsion coil spring is attached, wherein the stopper portion is provided on the support portion, and the stopper portion abuts a portion between the fitting portion fitted to the shaft portion of the torsion coil spring and the end portion of the torsion coil spring attached to the spring attaching portion.

5. The sheet conveying apparatus according to claim 1, wherein the biasing member is formed of a tension spring, an end portion of which is attached to the guide portion, and wherein when the guide portion is rotated in the direction that the guide portion opens against a force of the tension spring, the tension spring abuts the stopper portion to regulate the rotation of the guide portion.

6. The sheet conveying apparatus according to claim 1, further comprising:

a first attaching portion which is provided on the guide portion and on which one end portion of the biasing member is detachably hooked; and a second attaching portion which is provided on the support portion and on which another end portion of the biasing member is detachably hooked.

7. The sheet conveying apparatus according to claim 1, wherein the guide portion is detachable from the support portion in a state that the biasing member is detached.

8. An image forming apparatus comprising:

the sheet conveying apparatus according to claim 1; and an image forming portion which forms an image on a sheet conveyed by the sheet conveying apparatus.

9. The sheet conveying apparatus according to claim 1, wherein the biasing member is a spring and the spring contacts with the stopper portion to regulate the rotation of the guide portion when the guide portion is rotated in the direction that the guide portion opens against the biasing force of the spring.

* * * * *